United States Patent [19]

Matsueda et al.

[11] Patent Number: 4,738,346

[45] Date of Patent: Apr. 19, 1988

[54] DRIVING UNIT FOR PASSENGER CONVEYOR SYSTEM

[75] Inventors: Shigeo Matsueda; Eiki Watanabe; Takeshi Sakurada, all of Inazawa, Japan

[73] Assignee: Mitsubishi Denki Kabushiki Kaisha, Japan

[21] Appl. No.: 923,420

[22] Filed: Oct. 27, 1986

[30] Foreign Application Priority Data

Oct. 29, 1985 [JP] Japan ..... 60-242017
Dec. 4, 1985 [JP] Japan ..... 60-272975

[51] Int. Cl.[4] ..... B66B 21/00

[52] U.S. Cl. ..... 198/330; 198/619; 198/805; 198/856

[58] Field of Search ..... 198/330, 619, 856, 805; 318/35, 38, 135, 137

[56] References Cited

U.S. PATENT DOCUMENTS 3,577,929 5/1971 Onoda et al. ..... 318/35 X
3,707,220 12/1972 Boltrek et al. .
3,731,166 5/1973 Inuzuka et al. ..... 198/619 X
3,788,447 1/1974 Stephanoff ..... 198/619
3,845,375 10/1974 Stiebel ..... 198/856 X

FOREIGN PATENT DOCUMENTS 48-43231 12/1973 Japan .
49-18077 5/1974 Japan .
2096966 10/1982 United Kingdom ..... 198/619

*Primary Examiner*—Joseph E. Valenza
*Assistant Examiner*—Jonathan D. Holmes
*Attorney, Agent, or Firm*—Leydig, Voit & Mayer

[57] ABSTRACT

A passenger conveyor system is provided with a driving unit disposed at an upper horizontal portion of the system and a linear motor disposed at a midway portion of the system for driving the passenger conveyor, thereby not requiring the provision of expensive linear motors over a full rise of the system, and adding a linear motor to only a portion of the conventional system, while the comfort of the passengers is considerably improved.

6 Claims, 3 Drawing Sheets

DRIVING UNIT FOR PASSENGER CONVEYOR SYSTEM

BACKGROUND OF THE INVENTION

This invention relates to a passenger conveyor system, such as an escalator and a moving walk, for transporting passengers, and more particurly to a driving unit for the passenger conveyor for providing an improved comfort of the passengers riding on the conveyor having a high lift or a long course.

At present, an escalator system, as a passenger conveyor system, can be roughly divided into two types according to the type of driving system used. One is a modular type escalator system, as shown in FIG. 1, in which a compact driving unit 1 is mounted in an inclined portion of the escalator for driving an endless step chain 2 for both an upper bearing run and a lower return run. The other is a sprocket wheel type escalator in which a driving unit 1*a*, as shown in FIG. 2, is disposed at an upper horizontal section of the escalator for driving a main sprocket wheel 1*b* which drives an endless step chain 2.

In the former modular type escalator system, many driving units can be provided according to need when extending the length of the escalator, thereby making the escalator system compact. However, since the steps on which the passengers are standing are directly driven by the driving unit 1, vibration of the unit 1 can be easily propagated to the passengers, resulting in the reduced comfort of the passengers standing on the steps. Furthermore, the steps must be disassembled when repairing of the driving unit and, accordingly the maintenance of the system is both time consuming and tedious.

On the other hand, with the latter sprocket wheel type conveyor system in which the main sprocket wheel 1*a* is used for driving the step chain 2, the comfort of the passengers is improved. However, this system necessitates a large driving unit for a higher rise, resulting in the necessity of larger space of a machine room disposed at a upper portion of the escalator system.

In order to deal with such problems, an escalator using a linear motor has been proposed. However, this necessitates the provision of a plurality of linear motors as well as the provision of a mechanical brake for braking the escalator system and, accordingly, results in a complicated and costly structure.

SUMMARY OF THE INVENTION

Accordingly, an object of the present invention is to provide a passenger conveyor system which can be compactly constructed, in which the comfort of passengers is not reduced even for a higher rise and the maintenance of which is relatively easy.

The passenger conveyor system according to the present invention is constructed to be driven by an upper driving unit disposed at an upper end of the system and a linear motor provided substantially on a midway portion of the system.

DETAILED DESCRIPTION OF THE PREFERRED EMBODIMENTS

Figure 1:
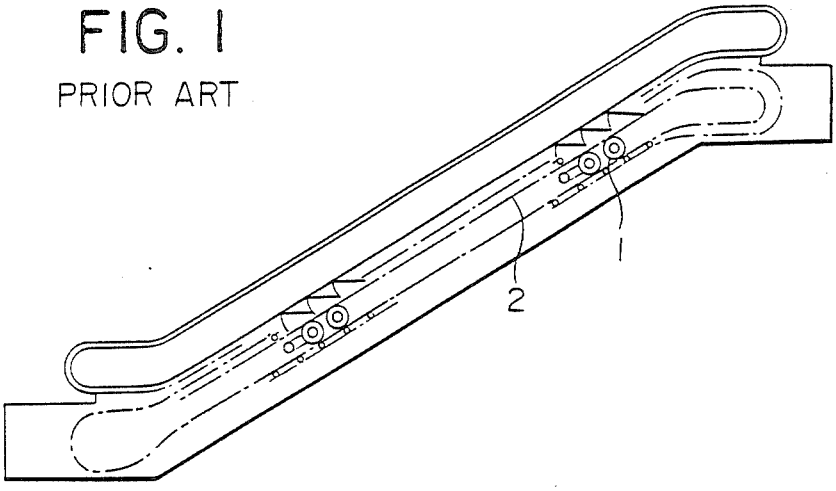
FIG. 1 PRIOR ART
FIG. 1 is a schematic elevation view of a conventional escalator.
Figure 2:
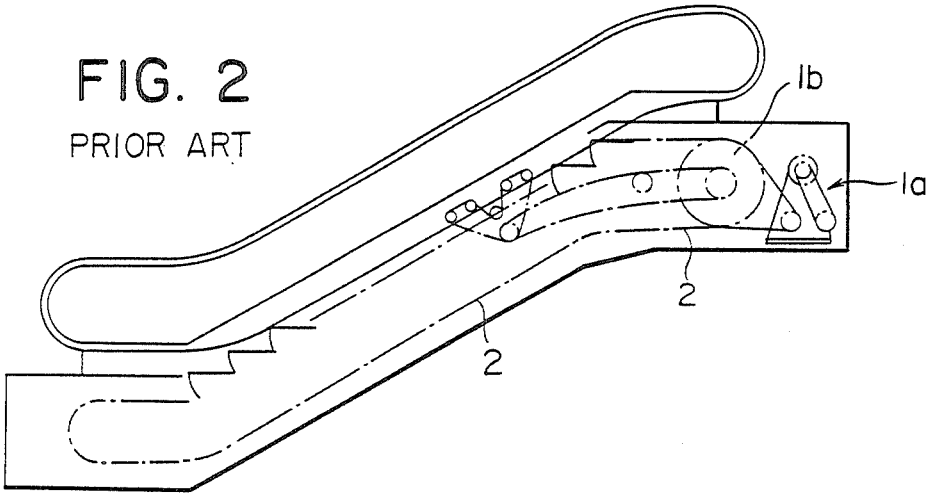
FIG. 2 PRIOR ART
FIG. 2 is a schematic elevation view of another conventional escalator.
Figure 3:
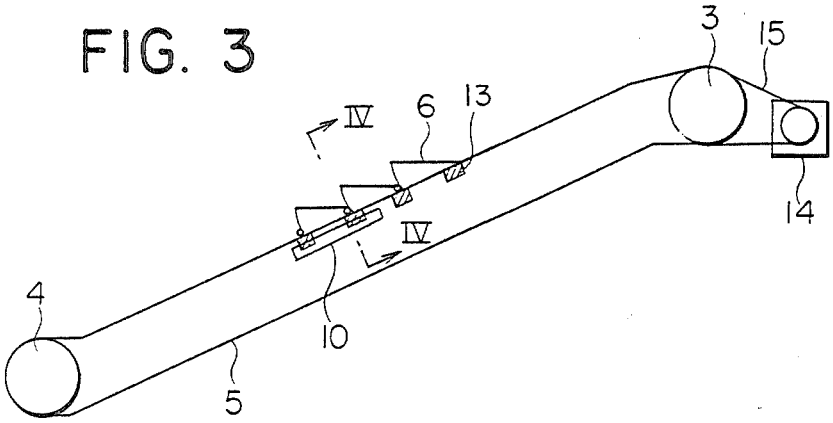
FIG. 3 is a schematic elevation view of an escalator system according to one embodiment of the present invention.
Figure 4:
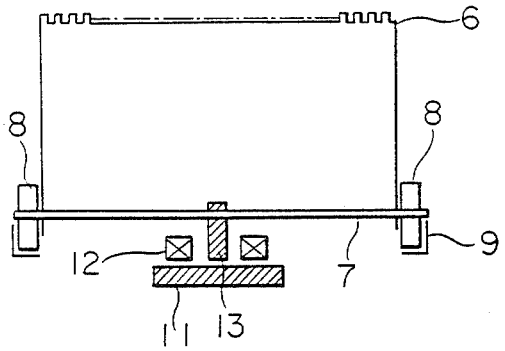
FIG. 4 is a cross-section view of the escalator system taken along lines IV—IV in FIG. 3.

FIG. 3 illustrates schematically a principle portion of an escalator system according to the present invention, FIG. 4 is a cross-section view of the escalator taken along IV—IV of FIG. 3. Referring to the figures, the escalator system comprises a main sprocket wheel 3 disposed at an upper horizontal portion of the escalator system and a sub-sprocket wheel 4 disposed at a lower horizontal portion of the escalator system, a step chain 5 supported over the main and sub sprockets wheels 3, 4, on which a plurality of steps 6 are endlessly mounted, each of said steps 6 being provided at both sides thereof with a pair of rollers 8 mounted on a shaft 7, which are guided along a pair of rails 9. The escalator system further comprises a linear motor 10 disposed substantially at a midway portion between the main sprocket wheel 3 and the sub-sprocket wheel 4, and a driving unit 14 connected to the main sprocket wheel 3 through a driving chain 15. The linear motor 10 comprises a stationary member having a primary conductor 11 and primary windings 12 fixed thereon, and a moving member comprising a secondary conductor 13 secured below each of the steps 6 for moving in the vicinity of the primary windings 12.

Figure 5:
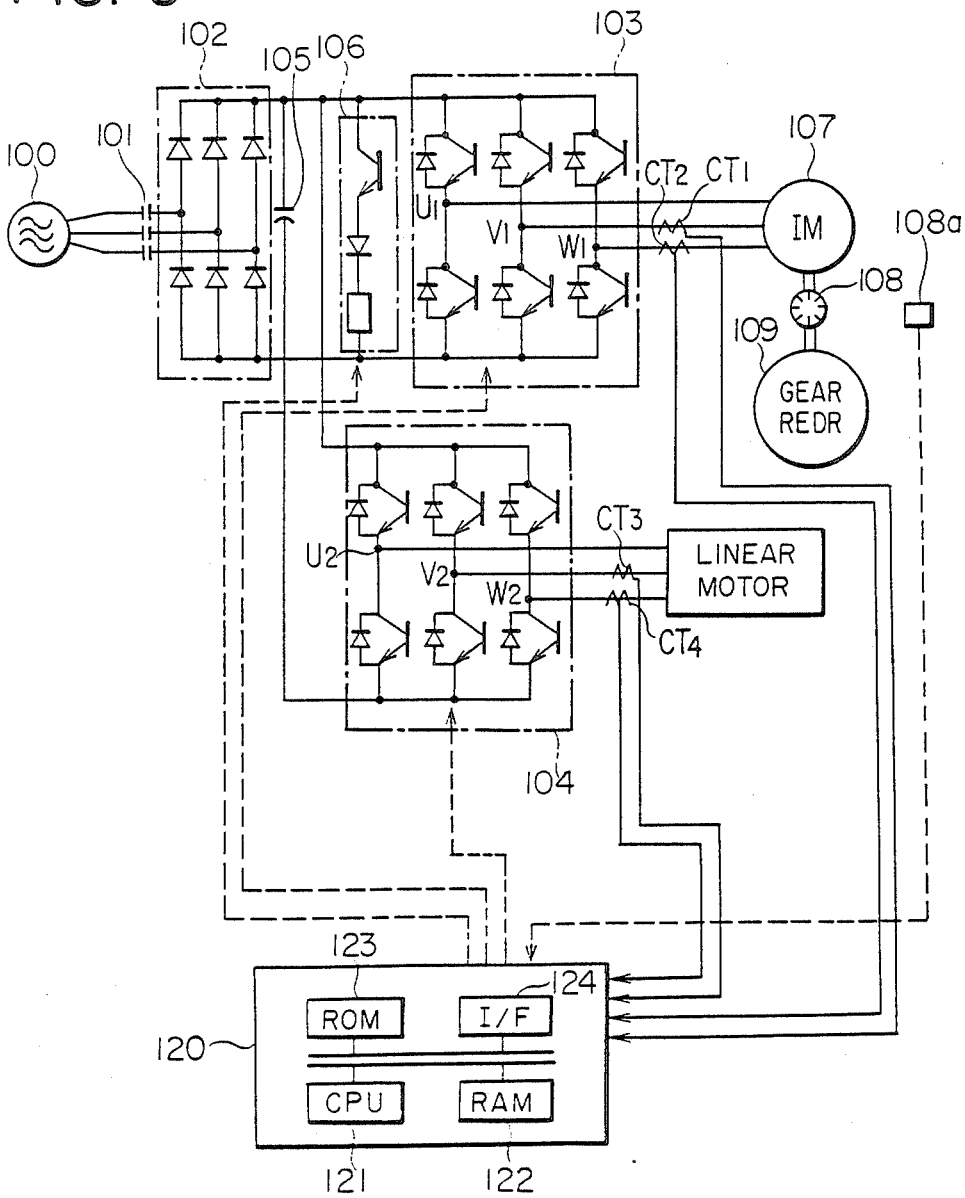
FIG. 5 is a circuit diagram of a control circuit of the driving unit and the linear motor shown in FIG. 3.

FIG. 5 is a circuit diagram of a drive and control circuit for the linear motor 10 and the driving unit 14. The drive and control circuit comprises a three phase AC power source 100, contacters 101, a converter 102, which includes diodes, connected to the three phase AC power source 100 through contactors 101, a first inverter 103, which comprises transistors and diodes which are connected in an anti-parallel relation with respect to the transistors, connected to outputs of the converter 102, a second inverter 104, which comprises transistors and diodes which are connected in an anti-parallel relation with respect to the transistors, connected in parallel with respect to the first inverter 103, a capacitor 105 connected between the outputs of the converter 102 and a regenerative power consuming circuit 106, which comprises a transistor, a diode and a resistor which are connected in series with each other, connected in parallel with the capacitor 105. An induction motor 107 utilized for driving the driving unit 14 is connected to outputs of the first inverter 103. A pulse generating disc 108 for generating pulses is mounted on a rotary shaft of the induction motor 107 which is used for driving the upper driving unit 14. A pulse detecting device 108*a* is provided in the vicinity of the pulse generating disc 108. A gear reducer 109 is connected to the rotary shaft of the induction motor 107 for driving the driving unit, by which the main sprocket wheel 3 is rotated. The linear motor 110 is connected to the outputs of the second inverter 104. Current detecters $CT_1$, $CT_2$ detect the current flowing through phases $V_1$,$W_1$ of the induction motor 107 utilized for the driving unit 14. Current detectors $CT_3$,$CT_4$ detect the current flowing through phases $V_2$,$W_2$ of the linear motor 110. A control device 120 comprises a microprocessor 121, a RAM 122, ROM 123 and an input and output interphase 124. The control device 120 receives output signals from the pulse detecter 108*a* and the current detectors $CT_1$–$CT_4$ for performing various calculations. In accordance with the calculated results, the control device 120 controls the transistors in the the first and second inverter 103, 104 and the transistors in the regenerative power consuming circuit 106.

In the embodiment as described above, a three phase AC current provided from the three phase AC power source 100 through the contacters 101 is once converted into a DC current and then smoothed by a condensor 105. The smoothed DC power source is controlled with pulse width modulation (PWM) in the first inverter 103, and converted into a power source having a variable voltage and variable frequency (VVVF) which is supplied to the induction motor 107 which drives the driving unit 14. The pulse generating disc 108 for generating pulses is provided on the rotary shaft of the induction motor 107 which drives the driving unit 14, so that the pulse detector 108*a* provided in the vicinity of the pulse generating disc 108 detects the number of rotation of the rotary shaft of the induction motor 107, the output of the detector 108*a* being inputted to the control device 120. The control device 120 controls the first inverter 103 so that the detected value is in accordance with the set value, by varying the voltage and frequency of the power source to be supplied to the induction motor 107. Output signals $CT_1CT_2$ are used to perform the PWM control.

On the other hand, electric power having a variable voltage and variable frequency which is controlled with the PWM is also supplied to the linear motor 110, the variable voltage and variable frequency being controlled such that the induction motor 107 drives the step chain 5 at the same speed as does the linear motor 107. The regenerative power consuming circuit 106 consumes the regenerative power under the control of the control device 120 is a regenerative state.

Now, during a light load mode of operation, i.e., when the passenger conveyor is driven with a few passengers, it is not economical to have the conveyor driven by both the induction motor 107 and the linear motor 110. In fact, since it is not possible to reduce a gap between the first conductor 11 and the second conductor 13 from a structural view point of the linear motor 110, an exciting current becomes large.

The slippage of the induction motor can be detected by comparing the output signals from the pulse detecting device in the control device and the output frequency of the first inverter 103. Accordingly, during light loads when the slippage is below a set value, the power supply to the linear motor 110 is stopped, thereby making it possible to reduce the energy consumption. In the control circuit as shown in FIG. 5, the control device 120 controls to smoothly start and stop the induction motor 107.

In the embodiment illustrated in FIGS. 3 and 4, in order that the secondary conductor 13 does not interfere with other members during the rotation thereof between the upper bearing run and the lower return run of the conveyor path of the steps 6, the secondary conductor 13 can not be made larger. In this respect, the escalator system has the problem in that the linear motor 10 does not have a sufficient driving force.

The present invention has been made to eliminate these problems.

Figure 6:
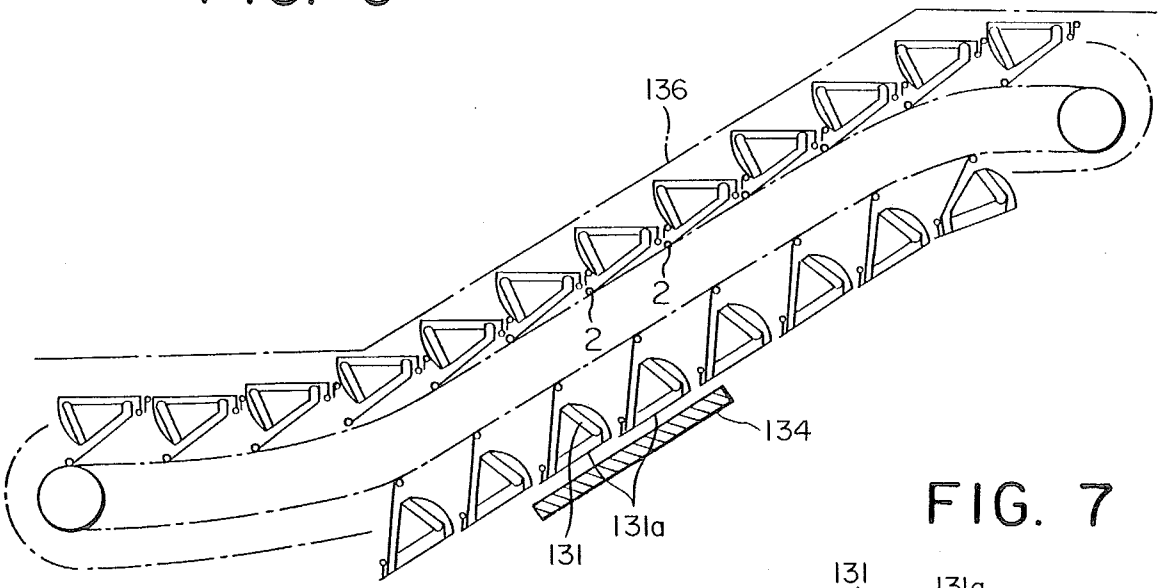
FIG. 6 is a schematic elevation view of a principal portion of an escalator system including a driving unit according to another embodiment of the present invention.

FIG. 6 illustrates a principal portion of the escalator driven by the driving unit according to another embodiment of the present invention. Referring to FIG. 6, tread plates 131*a* of a plurality of steps 131 are linearly aligned on the lower return run in an inclined portion of the escalator system. A primary iron core 134 has primary windings arranged at opposite relationship with respect to the tread plates 131*a* of the steps 131. The primary iron core 134 is secured to a frame 136 of the escalator system. Each of the tread plates 131*a* of the steps 131 comprises a conductor 70 such as iron or aluminium which is used as a secondary conductor for the linear motor. In this emobodiment, a single-sided linear motor is used.

Figure 7:
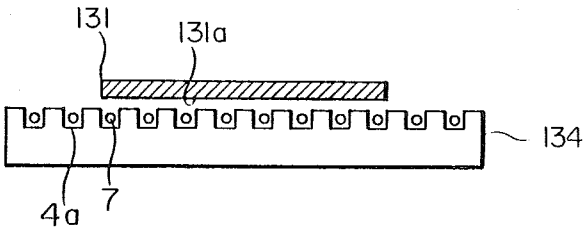
FIG. 7 is a cross-section view of a single-sided linear induction motor for use in the embodiment of FIG. 6.

FIG. 7 illustrates,in section, the single-sided linear motor of which the primary iron core 134 is secured to a frame ( not shown in FIG. 7).

In the illustrated embodiment, the tread plate 131*a* of the step 131 is made of a metallic conductor 70 such as aluminium or iron which may be used as a secondary conductor. The aluminium tread plate has a better driving characteristics when backing it with an iron plate on the rear side of the tread plate.

It should be noted that, although the desciption is given regarding the appliance of the present invention to the escalator system, but the invention can be similarly applied to a horizontally moving passenger conveyor.

According to the present invention, the passenger conveyor system is provided with a driving unit disposed at an upper horizontal portion of the system and also constructed so as to drive the passenger conveyor by means of a linear motor disposed at a midway portion of the moving stairway, thereby making it possible to provide a compact conveyor free from a complicated maintenance. Further,the comfort of the passengers is not deteriorated even on the upper portion of the escalator, and the power supply to the linear motor is stopped during the light load, so that the energy efficiency of system is considerably improved.

Still further, according to the present invention, the tread plates of the moving members such as a plurality of steps are used as a secondary conductor, and the primary iron core having primary windings of the linear motor is disposed at opposite relationship with respect to the tread plates, so that the linear motor has a sufficient driving force without any individual secondary conductor for each moving members thereby making it possible to provide an economical driving system for an moving walk.

What is claimed is:

1. A driving unit for a passenger conveyor system for conveying passengers by driving a plurality of steps which are endlessly connected to one another to form an endless loop including turn-around portions between an upper bearing run and a lower return run, comprising:

means disposed at one of said turn-around portions between an upper bearing run and a lower return run for driving said steps.

a linear motor disposed in the vicinity of said lower return run for driving said steps;

means for detecting the load on said steps;

control and drive means for controlling and driving both said driving means and said linear motor when a predetermined heavy load is detected by said detecting means, and to stop the linear motor and drive only said driving means when a load lighter than said predetermined heavy load is detected by said load detecting means; and each of said steps includes a tread plate that incorporates a conductive portion and said linear motor is provided with primary windings and a primary core on which said primary windings are wound, said primary core being disposed at a position in the vicinity of and below said lower return run so that said tread plates of said steps are linearly aligned and said conductive portions serve as secondary conductors of said linear motor.

2. A driving means for a passenger conveyor system according to claim 1 wherein said load detecting means comprises:

a pulse generating disc mounted on a rotary shaft of an AC electric motor connected to said driving means; and a pulse detecting means disposed at the vicinity of said pulse generating disc;

said control and drive means receiving output signals for said pulse detecting means to detect slippage of said electric motor, and is adapted to control and drive for the light load and the heavy load in accordance with said detected slippage.

3. A driving unit for a passenger conveyor according to claim 2 further comprising:

a first inverter for driving said AC electric motor connected to said driving means;

a second inverter for driving said linear motor;

current detecting means disposed between said first inverter and said AC electric motor, and said second inverter and said linear motor respectively for detecting output currents from each of said first and second inverters;

regenerative power consuming means connected to the outputs of said first and second inverters for consuming regenerative power generated in a regenerative driving state;

said control and drive means receiving outputs from said current detecting means to control each of said first and second inverter and to control said regenerative power consuming means at the regenerative driving state.

4. A driving unit for a passenger conveyor system according to claim 1 wherein each of said steps is provided with a secondary conductor therebelow, and said linear motor is disposed at a position where said linear motor is adjacent to said secondary conductor.

5. A driving unit for a passenger conveyor system according to claim 1 wherein said conductive material is aluminium.

6. A driving unit for a passenger conveyor system according to claim 1 wherein said conductive material is iron.

* * * * *